US008341839B2

(12) United States Patent
Ishida

(10) Patent No.: US 8,341,839 B2
(45) Date of Patent: Jan. 1, 2013

(54) METHOD FOR PRODUCING TERMINALS

(75) Inventor: Keiko Ishida, Makinohara (JP)

(73) Assignee: Yazaki Corporation, Tokyo (JP)

( * ) Notice: Subject to any disclaimer, the term of this patent is extended or adjusted under 35 U.S.C. 154(b) by 35 days.

(21) Appl. No.: 13/003,921

(22) PCT Filed: Jul. 14, 2009

(86) PCT No.: PCT/JP2009/062762

§ 371 (c)(1),
(2), (4) Date: Jan. 13, 2011

(87) PCT Pub. No.: WO2010/007999

PCT Pub. Date: Jan. 21, 2010

(65) Prior Publication Data

US 2011/0119913 A1 May 26, 2011

(30) Foreign Application Priority Data

Jul. 15, 2008 (JP) ..... 2008-183889

(51) Int. Cl.
*H01R 43/00* (2006.01)

(52) U.S. Cl. ..... 29/884; 29/874; 29/882; 439/786; 439/787

(58) Field of Classification Search ..... 29/874, 29/882, 884; 439/786, 787
See application file for complete search history.

(56) References Cited

U.S. PATENT DOCUMENTS

| | | | | |
|---|---|---|---|---|
| 5,722,925 | A * | 3/1998 | Kameyama et al. | 600/453 |
| 6,077,131 | A * | 6/2000 | Fukuda et al. | 439/884 |
| 6,098,285 | A * | 8/2000 | Tsuji | 29/863 |
| 7,114,253 | B2 * | 10/2006 | Murakami et al. | 29/884 |
| 7,238,064 | B2 | 7/2007 | Nakamura et al. | |
| 7,338,334 | B2 | 3/2008 | Kumakura | |
| 7,442,097 | B2 | 10/2008 | Kumakura | |
| 2003/0017757 | A1 * | 1/2003 | Murakami et al. | 439/884 |

FOREIGN PATENT DOCUMENTS

| | | | |
|---|---|---|---|
| JP | 2000-200667 | A | 7/2000 |
| JP | 2004-181516 | A | 7/2004 |
| JP | 2006-216320 | A | 8/2006 |
| JP | 2006-269150 | A | 10/2006 |
| JP | 2008-103140 | A | 5/2008 |

OTHER PUBLICATIONS

International Search Report (PCT/ISA/210) issued for PCT/JP2009/062762, dated Sep. 29, 2009.

* cited by examiner

*Primary Examiner* — Carl Arbes
(74) *Attorney, Agent, or Firm* — Sughrue Mion, PLLC

(57) ABSTRACT

The goal is to enhance the productivity by reducing the cost of a die. A method for selectively forming a female terminal (30) and a male terminal (40), each terminal having a square tubular box portion (31, 41) in its front and a wire crimping portion (38, 39, 48, 49) in its rear, from blanks (20) punched into a common shape is provided. In a step of punching the blank, a front projection (22) which becomes a spring piece (32) when the female terminal is produced and becomes a male tab (42) when the male terminal is produced is projected from the front end of a strip-like base plate (21) constituting a bottom plate of the square tubular box portion, and a blank in which right and left projections (28, 29) constituting the wire crimping portions are projected is formed in the rear of the base plate. In the subsequent pressing step, the female terminal and the male terminal are selectively formed in response to whether the front projection (22) is folded backward or left as it is, while the blank is made common for the box portions.

4 Claims, 5 Drawing Sheets

(a)

(b)

(c)

METHOD FOR PRODUCING TERMINALS

TECHNICAL FIELD

The present invention relates to a method for producing terminals by selectively forming at least a part of a female terminal and a male terminal from one type of blank.

BACKGROUND ART

Generally, since a female terminal and a male terminal used in a connector are different in shape from each other, they are produced by punching out from different shape of blanks and bending work of the blanks by pressing.

An example of a case for producing the female terminal is described in Patent Literature 1. FIG. 6 and FIG. 7 show the example described in Patent Literature 1, for example. FIG. 6 shows a blank for the female terminal punched out from a material 210. FIG. 7 shows a state where the female terminal is formed by folding the blank.

As shown in FIG. 7, the female terminal 230 includes a square tubular box portion 231 in which a spring piece (not shown in figures) is mounted in the front side, and includes a conductor crimping portion 238 and a sheath crimping portion 239 as wire crimping portions in the rear side. The female terminal 230 is formed by bending work of a blank 220 which is punched out into a shape as shown in FIG. 6.

As shown in FIG. 6, in the blank 220, a front projection 222 for constituting the spring piece is projected on a front end of the strip-like base plate 221, rectangular plate portions 223 for constituting the box portion 231 including the base plate 221 as a bottom plate is extended from right and left sides of the base plate 221, and right and left projections 228, 229 for constituting the conductor crimping portion 238 and the sheath crimping portion 239 as the wire crimping portions are projected on right and left sides of the rear of the base plate 221, respectively. Production is made in chains by connecting the rear ends of the blanks 220 to a carrier 221.

Then, the front projection 222 of the blank 220 is folded backward to form the spring piece. The box portion 231 is formed by bending the rectangular plate portions 223 while regarding the base plate 221 as the bottom plate of the box portion 231 so as to contain the spring piece inside the box portion 231. Further, each of the right and left projections 228, 229 is bent upward in U-shape cross-section to form the conductor crimping portion 238 and the sheath crimping portion 239. As a result, the female terminal 230 is produced.

In this way, the female terminal is produced by punching a dedicated blank and bending press of the blank by pressing.

The male terminal is also produced in the same way as in the example described in Patent Literature 1, for example, and the male terminal is produced by punching a dedicated blank and bending press of the blank by pressing.

Citation List

Patent Literature

Patent Literature 1: JP-A-2008-103140
Patent Literature 2: JP-A-2006-216320

SUMMARY OF INVENTION

Technical Problem

In a case where the female terminal and the male terminal are produced by blanks having different shapes as in a conventional manner, since the respective blanks must be formed by different dies, the productivity is low.

In consideration with the circumstance, an object of the present invention is to provide a method for producing terminals by which the productivity is improved by reducing the cost of the die.

Solution to Problem

A method for producing terminals according to an aspect of the invention is a method for producing terminals by selectively forming a female terminal and a male terminal, the method including the steps of punching and forming a common blank which has a strip-like base plate, a front projection which is projected from one end of the base plate toward a longitudinal direction of the base plate, and right and left projections which are projected at a side of the other end of the base plate toward a lateral direction of the base plate; when the female terminal is to be produced, folding back the front projection toward the side of the other end of the base plate to form a spring piece and forming a box portion so as to contain the spring piece inside the box portion by regarding the base plate as a bottom plate of the box portion, whereas, when the male terminal is to be produced, leaving the front projection as it is to form a male tab projecting forward and forming a box portion by regarding the base plate as a bottom plate of the box portion; and bending the right and left projections to form a wire crimping portion having a U-shape cross-section.

A method for producing terminals according to an aspect of the invention is a method for producing terminals by selectively forming a female terminal and a male terminal, the method including the steps of: punching and forming a first blank which has a strip-like base plate, a front projection which is projected from one end of the base plate toward a longitudinal direction of the base plate, and right and left projections which are projected at a side of the other end of the base plate toward a lateral direction of the base plate; punching and forming second blanks having rectangular shapes; bending the second blanks into C-shape cross-sections including top plates and right and left side plates; when the female terminal is to be produced, folding back the front projection toward the side of the other end of the base plate to form a spring piece and forming a box portion so as to contain the spring piece inside the box portion by regarding the base plate as a bottom plate of the box portion and by jointing the right and left side plates to the bottom plate with the second blank being covered above the base plate, whereas, when the male terminal is to be produced, leaving the front projection as it is to form a male tab projecting forward and forming a box portion by regarding the base plate as a bottom plate of the box portion and by jointing the right and left side plates to the bottom plate with the second blank being covered above the base plate; and bending the right and left projections to form a wire crimping portion having a U-shape cross-section.

The method for producing terminals may be processed so that, in the step of punching and forming the first blank, in a state where a carrier is arranged in width direction on each end of a strip plate material, and rear ends of the respective first blanks are connected to the carriers, the first blanks are directed in width direction of the strip plate material oppositely toward each other and alternately disposed in a longitudinal direction of the strip plate material to punch out the first blanks in two rows consecutively.

The method for producing terminals may be processed so that the second blank for the female terminal and the second blank for the male terminal are different in shape or in size from each other, and the second blank for the female terminal and the second blank for the male terminal are punched and formed from the same plate material.

Advantageous Effects of Invention

According to the aspect of the invention, since main parts of the female terminal and the male terminal are selectively formed in response to whether the front projection of the blank which is punched in a common shape is folded backward to form the spring piece or is left as it is to form the male tab, a punching die for the main parts of the female/male terminals can be made common. Accordingly, the productivity can be improved.

According to the other aspect of the invention, since main parts of the female terminal and the male terminal are selectively formed in response to whether the front projection of the blank which is punched in a common shape is folded backward to form the spring piece or is left as it is to form the male tab, a punching die for the main parts of the female/male terminals can be made common. Accordingly, the productivity can be improved. In addition, since the box portion is also provided on the male terminal, the box portion can be used for a subject to be engaged with a lance within a cavity when the terminal is inserted into the cavity of a connector housing. Further, since the upper part of the box portion is formed from a separate blank (the second blank), the waste in materials is reduced to achieve the reduction of the cost, and also the complicated bending work is reduced to improve the productivity.

Further, since the blanks are punched out in two rows in chain from a single piece of a strip plate material, the efficiency of materials is improved.

Further, the box parts of the female terminal and the male terminal can be different in shape or size from each other.

DESCRIPTION OF EMBODIMENTS

Hereinafter, a description is made of embodiments of the invention with reference to drawings.

(First Embodiment)

Figure 1:
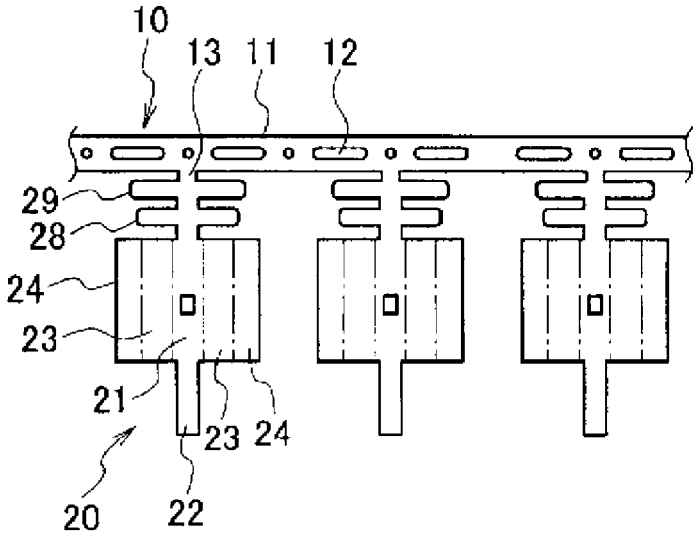
FIG. 1 is an explanatory diagram of a method for producing terminals according to a first embodiment of the invention, in which (a) is a plan view of chained blanks produced in a punching step; (b) is an external perspective view of a female terminal produced in a pressing step; and (c) is en external perspective view of a male terminal produced in a pressing step.
Figure 1:
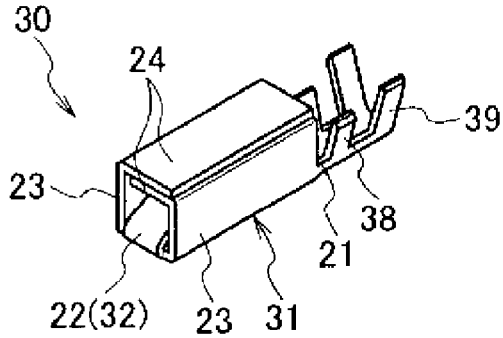
Figure 1:
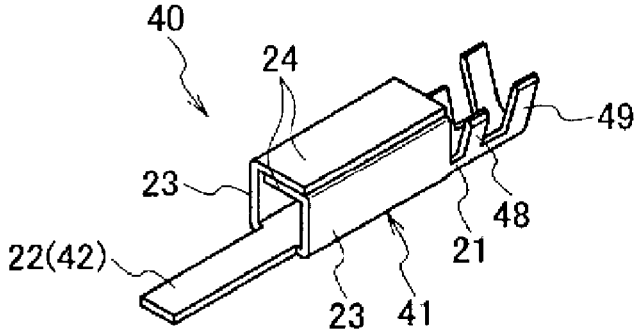

FIG. 1 is an explanatory diagram of a method for producing terminals according to a first embodiment of the invention, in which (a) in FIG. 1 is a plan view of chained blanks produced in a punching step; (b) in FIG. 1 is an external perspective view of a female terminal produced in a pressing step; and (c) in FIG. 1 is en external perspective view of a male terminal produced in a pressing step.

The method for producing terminals of this embodiment corresponds to a method for selectively forming a female terminal 30 and a male terminal 40, each terminal including a square tubular box portion 31, 41 in its front and a wire crimping portion (a conductor crimping portion 38, 48 and a sheath crimping portion 39, 49) in its rear, as shown by (b) in FIG. 1 and (c) in FIG. 1, from a blank 20 having one type of common shape punched into a common shape, as shown by (a) in FIG. 1. The method for producing terminals of this embodiment includes a blank punching step of punching out a blank 20 from a material 10 as shown by (a) in FIG. 1, and after the step, a pressing step of forming the female terminal 30 and the male terminal 40 as shown by (b) in FIG. 1 and (c) in FIG. 1.

First, in the blank punching step, a front projection 22 which becomes a spring piece 32 when the female terminal 30 is produced and becomes a male tab 42 when the male terminal 40 is produced is projected from a front end of a strip-like base plate 21 constituting a bottom plate of the square tubular box portion 31, 41. Side plates 23 and top plates 24 of the box portion 31, 41 are consecutively provided from right and left sides of the base plate 21. Further, a blank 20 in which right and left projections 28, 29 constituting the wire crimping portions (the conductor crimping portion 38, 48 and the sheath crimping portion 39, 49) both when the female terminal 30 is to be produced and when the male terminal 40 is to be produced are projected in the rear of the base plate 21 is formed. The blanks 20 are formed in a chained form in which rear ends of the respective blanks 20 are connected via interconnecting portions 13 to a strip-like carrier having feeding apertures 12.

Next, in the pressing step, the female terminal 30 and the male terminal 40 are selectively formed. That is, when the female terminal 30 is to be produced, the front projection 22 of the blank 20 is folded backward to form the spring piece 32 and the box portion 31 having the base plate 21 as a bottom plate and the side plates 23 and the top plates 24 which are folded inward is formed so as to contain the spring piece 32 inside the box portion 31. Further, the right and left projections 28, 29 are bent upward to form the wire crimping portion (the conductor crimping portion 38 and the sheath crimping portion 39) having a U-shape cross-section.

On the other hand, when the male terminal 40 is to be produced, the front projection 22 is left as it is to form the male tab 42 projecting forward and the box portion 41 having the base plate 21 as a bottom plate and the side plates 23 and the top plates 24 which are folded inward is formed. Further, the right and left projections 28, 29 are bent upward to form the wire crimping portion (the conductor crimping portion 48 and the sheath crimping portion 49) having a U-shape cross-section.

Accordingly, even if the common blank 20 is used, the female terminal 30 and the male terminal 40 are selectively formed.

In this way, according to the method for producing terminals of this embodiment, since the female terminal 30 and the male terminal 40 are selectively formed in response to whether the front projection 22 of the blank 20 which is punched in a common shape is folded backward to form the spring piece 32 or is left as it is to form the male tab 42, a punching die for the female/male terminals can be made common. Accordingly, the productivity can be improved.

(Second Embodiment)

Figure 2:
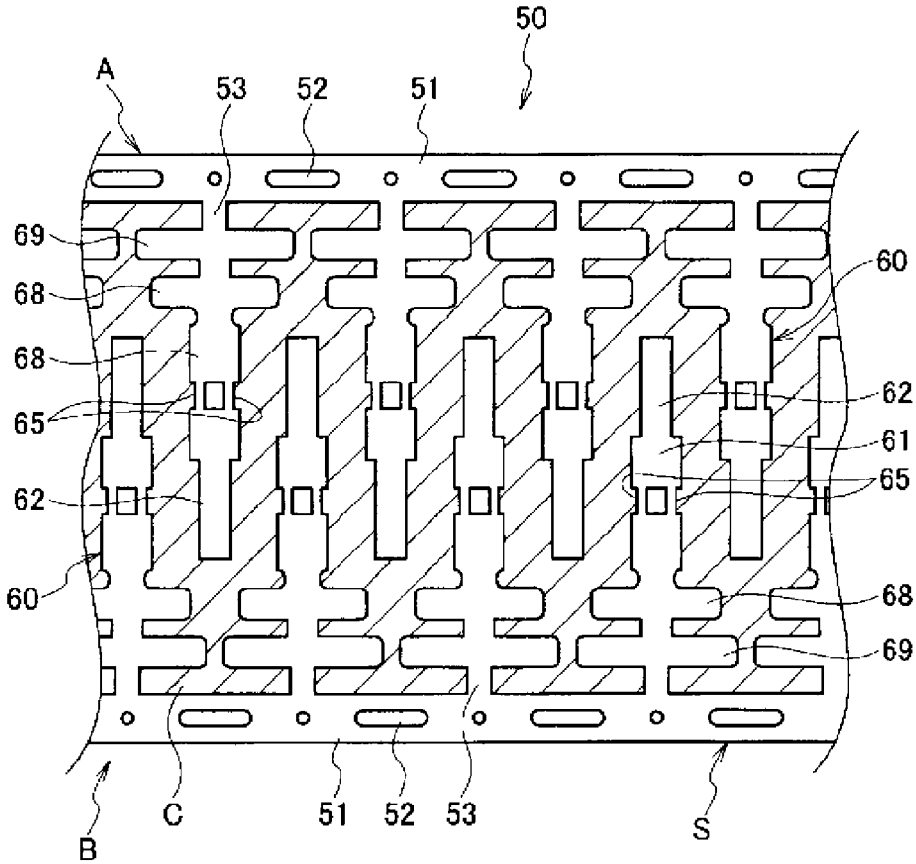
FIG. 2 is an explanatory diagram of a method for producing terminals according to a second embodiment of the invention, and is a plan view of chained first blanks produced in a first blank punching step.
Figure 3:
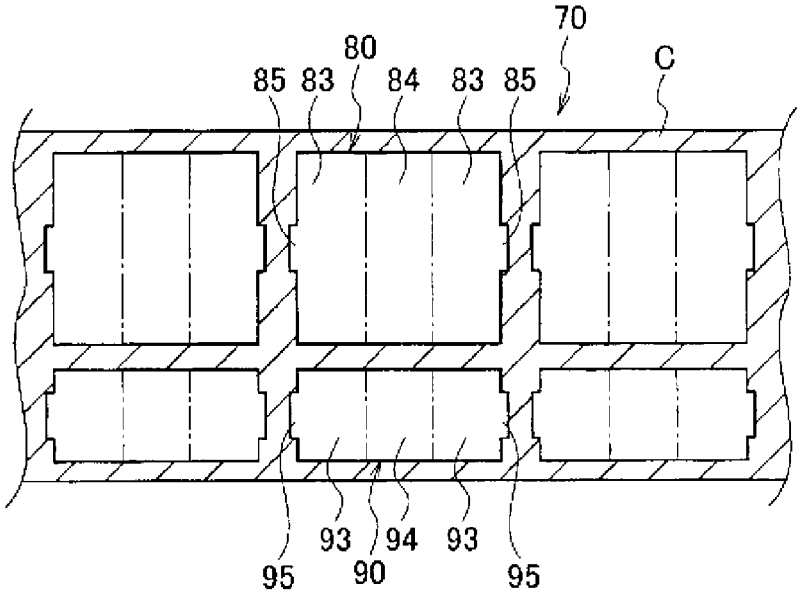
FIG. 3 is a plan view of second blanks produced in a second blank punching step.
Figure 4:
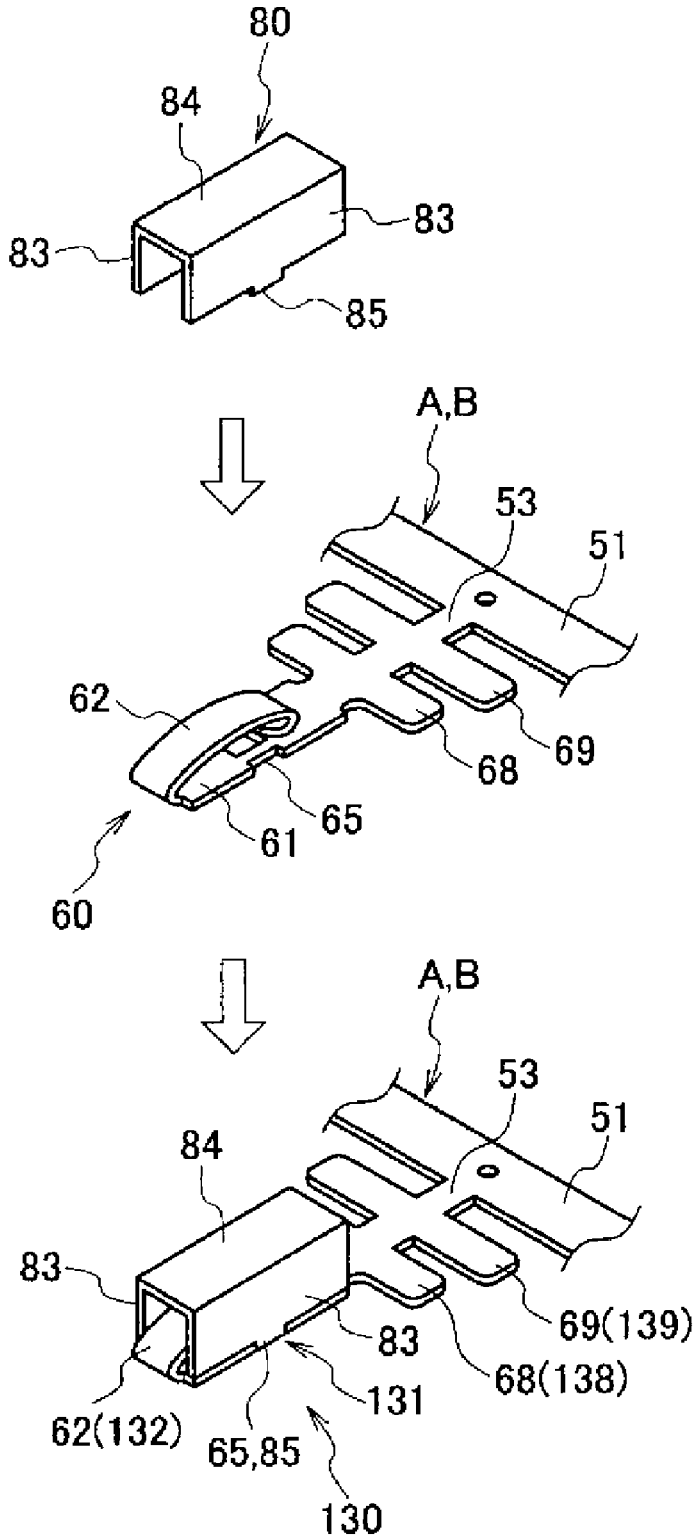
FIG. 4 is an explanatory diagram of steps in a case where the female terminal is to be produced using a common blank.
Figure 5:
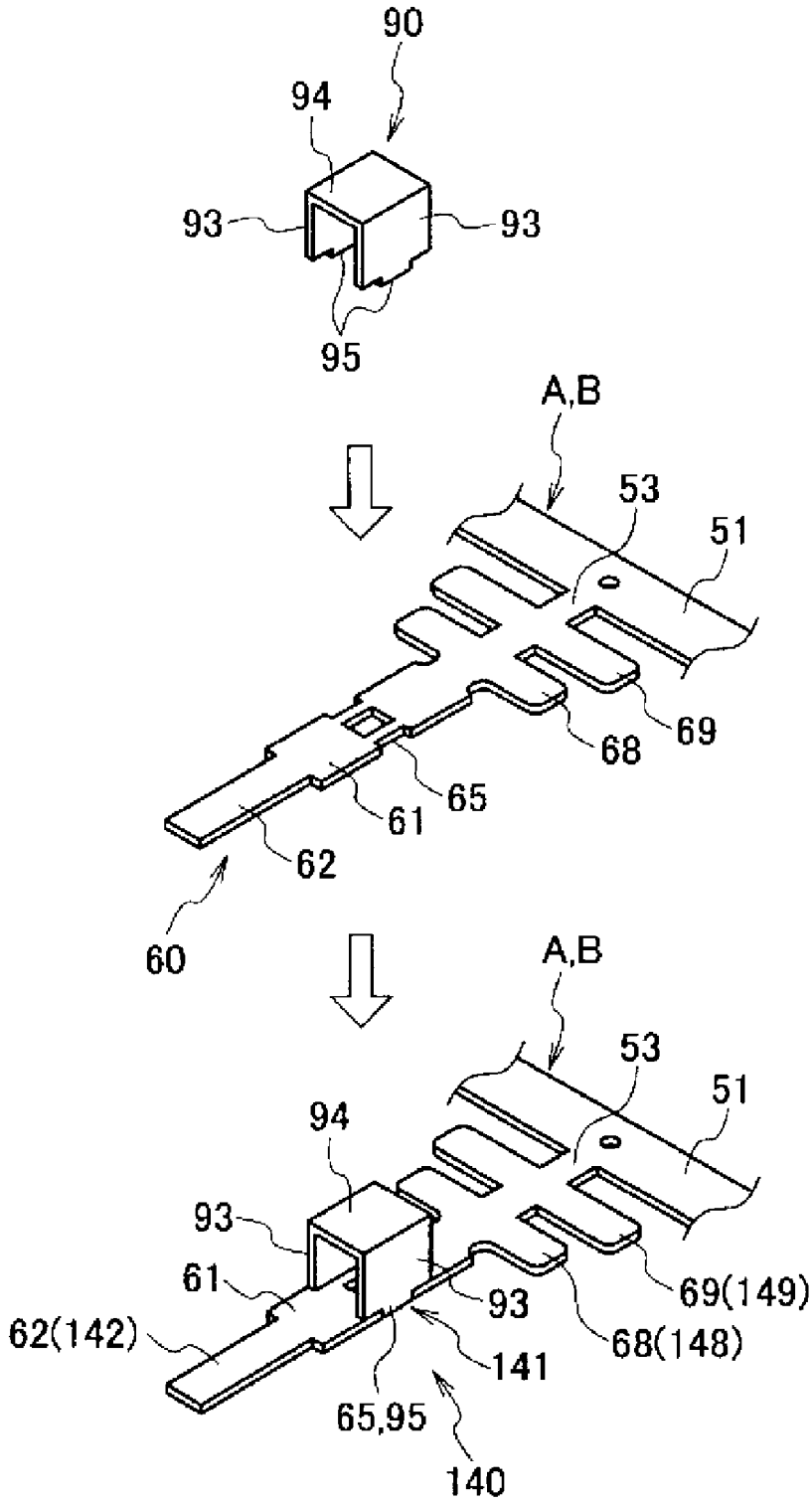
FIG. 5 is an explanatory diagram of steps in a case where the male terminal is to be produced using the common blank.
Figure 6:
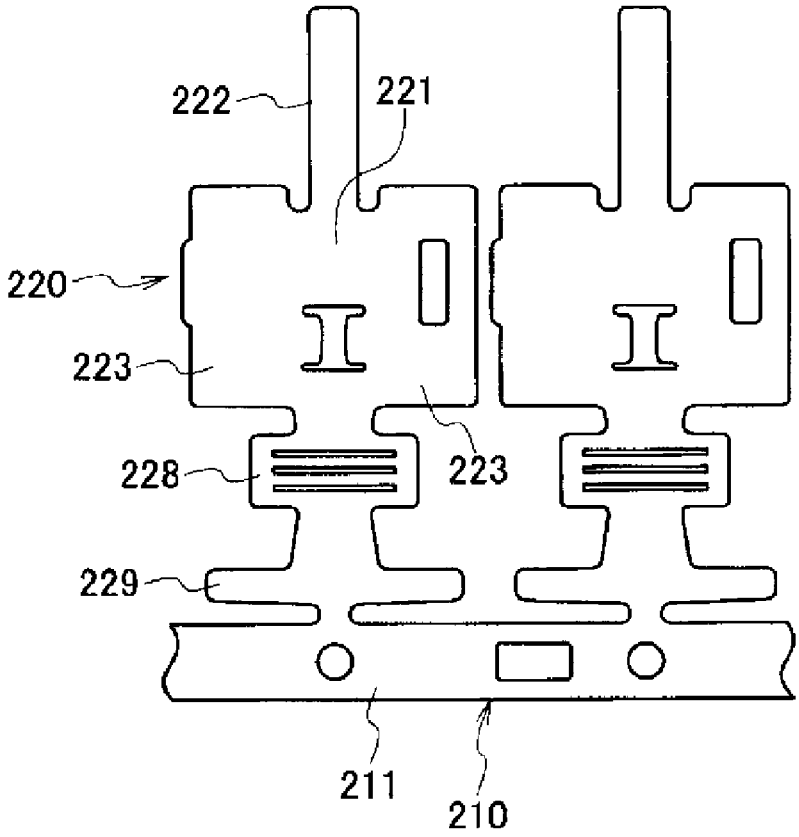
FIG. 6 is an explanatory diagram of a method for producing terminals according to the related art, and is a plan view showing a blank for a female terminal which is punched out from a material.
Figure 7:
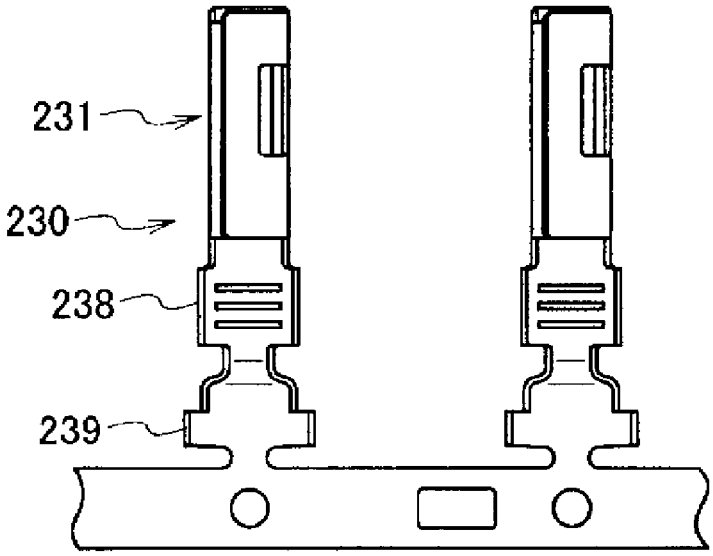
FIG. 7 shows a state where the female terminal is formed by bending the blank shown in FIG. 6.

FIGS. 2 to 5 are explanatory diagrams of a method for producing terminals according to a second embodiment. FIG. 2 is a plan view of chained first blanks produced in a first blank punching step. FIG. 3 is a plan view of second blanks produced in a second blank punching step. FIG. 4 is an explanatory diagram of steps in a case where the female terminal is to be produced using a common blank. FIG. 5 is an explanatory diagram of steps in a case where the male terminal is to be produced using the common blank.

The method for producing the terminals corresponds to a method of selectively forming a female terminal 130 and a male terminal 140, each terminal including a square tubular box portion 131, 141 in its front and a wire crimping portion (a conductor crimping portion 138, 148 and a sheath crimping portion 139, 149) in its rear, as shown in FIG. 4 and FIG. 5, by assembling a first blank 60 having one type of common shape which is punched out as shown in FIG. 2 and second blanks 80, 90 which are punched out as shown in FIG. 3. The method for producing terminals according to this embodiment includes a first blank punching step of punching a blank 60 from a material 50 as shown in FIG. 2, a second blank punching step of punching blanks 80, 90 from a material 70 as shown in FIG. 3, and after the steps, a pressing step of forming the female terminal 30 and the male terminal 40 as shown in FIG. 4 and FIG. 5.

First, in the first blank punching step, as shown in FIG. 2, a front projection 62 which becomes a spring piece 132 when the female terminal 130 is produced and becomes a male tab 142 when the male terminal 140 is produced is projected from a front end of a strip-like base plate 61 constituting a bottom plate of the square tubular box portion 131, 141. Then, engage grooves 65 are formed on right and left sides of the base plate 61. Further, a first blank 60 in which right and left projections 68, 69 constituting the wire crimping portions (the conductor crimping portion 138, 148 and the sheath crimping portion 139, 149) both when the female terminal 130 is to be produced and when the male terminal 140 is to be produced are projected in the rear of the base plate 61 is formed. In this case, in the first blank punching step, the first blanks 60 are arranged, and a carrier 51 is arranged in width direction on each end of a strip plate material S. Then, in a state where rear ends of the respective first blanks 60 are connected to the carriers 51, the first blanks 60 are directed in width direction of the strip plate material S oppositely toward each other and alternately disposed in a longitudinal direction of the strip plate material S to punch out the first blanks 60 in two rows A, B consecutively.

Further, in the second punching step, as shown in FIG. 3, the second blanks 80, 90 having a rectangular shape constituting box portions 131, 141 excluding the base plate and including top plates 84, 94 and right and left side plates 83, 93 are formed. Here, the second blank 80 for the female terminal 130 and the second blank 90 for the male terminal 140 may be the same in shape or in size as each other, and alternatively may be different in shape or size from each other. Engage convexes 85, 95 to be engaged with the engage grooves 65 are provided on side edges of the side plates 83, 93 of the second blanks 80, 90.

Next, in the pressing step, the female terminal 130 and the male terminal 140 are selectively formed as shown in FIG. 4 and FIG. 5.

That is, when the female terminal 130 is to be produced, the front projection 62 of the blank 60 is folded backward to form the spring piece 132. Then, the square tubular box portion 131 is formed so as to contain the spring piece 132 inside the box portion 131 by regarding the base plate 61 as a bottom plate of the box portion 131 and folding the second blank 80 in a C-shape cross-section including the top plates 84 and the right and left plates 83 and jointing (e.g., welding or soldering) the right and left plates 83 to the base plate 61 with the second blank 80 covered above the base plate. Further, the right and left projections 68, 69 are bent upward to form the wire crimping portion (the conductor crimping portion 138 and the sheath crimping portion 139) having a U-shape cross-section.

On the other hand, when the male terminal 140 is to be produced, the front projection 62 is left as it is to form the male tab 142 projecting forward. Then, the square tubular box portion 141 is formed by regarding the base plate 61 as a bottom plate of the box portion 141 and folding the second blank 90 in a C-shape cross-section including the top plates 94 and the right and left plates 93 and jointing (e.g., welding or soldering) the right and left plates 93 to the base plate 61 with the second blank 90 covered above the base plate.

Accordingly, even if the common blank 60 is used, main parts of the female terminal 130 and the male terminal 140 are selectively formed.

In this way, according to the method for producing terminals of this embodiment, since the main parts of the female terminal 130 and the male terminal 140 are selectively formed in response to whether the front projection 62 of the blank 60 which is punched in a common shape is folded backward to form the spring piece 132 or is left as it is to form the male tab 142, a punching die for the main parts of the female/male terminals can be made common. Accordingly, the productivity can be improved.

In addition, since the box portion 141 is also provided on the male terminal 140, the box portion 141 can be used for a subject to be engaged with a lance within a cavity when the terminal is inserted into the cavity of a connector housing.

Further, since the upper part of the box portion 141 is formed from a separate blank (the second blank 80, 90), the waste in materials is reduced to achieve the reduction of the cost, and also the complicated bending work is reduced to improve the productivity. Further, since the blanks 60 are punched out in two rows in chain from a single piece of a strip plate material S, the efficiency of materials is improved. That is, as shown in FIG. 2 and FIG. 3, the wasted parts shown by C (hatched parts) are extremely reduced and the productivity is improved.

Industrial Applicability

According to the method for producing terminals of the invention, the female terminal and the male terminal are selectively formed using a blank having a common shape, and the productivity is improved by reducing the cost of the die.

Reference Signs List

20: Blank
21: Base plate
22: Front projection
28, 29: Right and left projections
30: Female terminal
31: Box portion
32: Spring piece
38: Conductor crimping portion (Wire crimping portion)
39: Sheath crimping portion (Wire crimping portion)
40: Male terminal
41: Box portion
42: Male tab
48: Conductor crimping portion (Wire crimping portion)
49: Sheath crimping portion (Wire crimping portion)
60: First blank

61: Base plate
62: Front projection
68, 69: Right and left projections
80, 90: Second blank
83, 93: Side plate
84, 94: Top plate
130: Female terminal
131: Box portion
132: Spring piece
138: Conductor crimping portion (Wire crimping portion)
139: Sheath crimping portion (Wire crimping portion)
140: Male terminal
141: Box portion
142: Male tab
148: Conductor crimping portion (Wire crimping portion)
149: Sheath crimping portion (Wire crimping portion)
S: Strip plate material

The invention claimed is:

1. A method for producing terminals by selectively forming a female terminal and a male terminal, the method comprising the steps of:

punching and forming a common blank which has a strip-like base plate, a front projection which is projected from one end of the base plate toward a longitudinal direction of the base plate, and right and left projections which are projected at a side of the other end of the base plate toward a lateral direction of the base plate;

when the female terminal is to be produced, folding back the front projection toward the side of the other end of the base plate to form a spring piece and forming a box portion so as to contain the spring piece inside the box portion by regarding the base plate as a bottom plate of the box portion, whereas, when the male terminal is to be produced, leaving the front projection as it is to form a male tab projecting forward and forming a box portion by regarding the base plate as a bottom plate of the box portion; and bending the right and left projections to form a wire crimping portion having a U-shape cross-section.

2. A method for producing terminals by selectively forming a female terminal and a male terminal, the method comprising the steps of:

punching and forming a first blank which has a strip-like base plate, a front projection which is projected from one end of the base plate toward a longitudinal direction of the base plate, and right and left projections which are projected at a side of the other end of the base plate toward a lateral direction of the base plate;

punching and forming second blanks having rectangular shapes;

bending the second blanks into C-shape cross-section including top plates and right and left side plates;

when the female terminal is to be produced, folding back the front projection toward the side of the other end of the base plate to form a spring piece and forming a box portion so as to contain the spring piece inside the box portion by regarding the base plate as a bottom plate of the box portion and by jointing the right and left side plates to the bottom plate with the second blank being covered above the base plate, whereas, when the male terminal is to be produced, leaving the front projection as it is to form a male tab projecting forward and forming a box portion by regarding the base plate as a bottom plate of the box portion and by jointing the right and left side plates to the bottom plate with the second blank being covered above the base plate; and bending the right and left projections to form a wire crimping portion having a U-shape cross-section.

3. The method for producing terminals according to claim 2, wherein in the step of punching and forming the first blank, a carrier is arranged in width direction on each end of a strip plate material, and in a state where rear ends of the respective first blanks are connected to the carriers, the first blanks are directed in width direction of the strip plate material oppositely toward each other and alternately disposed in a longitudinal direction of the strip plate material to punch out the first blanks in two rows consecutively.

4. The method for producing terminals according to claim 2, wherein the second blank for the female terminal and the second blank for the male terminal are different in shape or in size from each other, and the second blank for the female terminal and the second blank for the male terminal are punched out and formed from the same plate material.

* * * * *